United States Patent [19]

Quinlan

[11] 4,020,724

[45] May 3, 1977

[54] ROTARY CUTTING DIE

[76] Inventor: Albert J. Quinlan, 124 Ward Road, North Tonawanda, N.Y. 14120

[22] Filed: Feb. 6, 1975

[21] Appl. No.: 547,783

[52] U.S. Cl. ..... 83/346; 83/674; 93/58.2 R; 93/58.4; 83/699

[51] Int. Cl.[2] ..... B26D 1/12; B31B 1/16

[58] Field of Search ..... 83/346, 674, 673, 663, 83/675, 699, 700; 93/58.2 R, 58.4

[56] References Cited

UNITED STATES PATENTS

| | | | |
|---|---|---|---|
| 2,863,337 | 12/1958 | Ackley | 93/58.2 R |
| 3,479,931 | 11/1969 | Bishop | 93/58.2 R |
| 3,752,042 | 8/1973 | Castlle | 93/58.2 R |
| 3,857,314 | 12/1974 | Gregoire | 83/674 |

*Primary Examiner*—Donald R. Schran
*Attorney, Agent, or Firm*—Sommer & Sommer

[57] ABSTRACT

A rotary cutting die is adapted to be mounted on a rotatable cylindrical die drum of a rotary press to cut a planar object passed between such rotating die drum and a cooperative oppositely-rotating anvil drum of said press. The rotary die includes: a die board having a concave surface adapted to cover a portion of the die drum, an opposite convex surface, and a plurality of openings therethrough; a plurality of fasteners adapted to selectively hold the die board to the die drum; a plate-like knife member adapted to be mounted on the die board at any of a plurality of large incremental positions in a longitudinal direction; and holding means mounted on the die board and selectively operable to hold the knife member at any selected one of the large incremental positions. In one embodiment, the die board openings are longitudinally-elongated to permit the die board to be shifted longitudinally relative to the die drum. In another embodiment, the die board openings are circumferentially-elongated and uniquely spaced from one another in a longitudinal direction such that some of the die board openings will register with some of the die drum holes at any of a plurality of discrete positions in a longitudinal direction. In this embodiment, compound movement of the die board and the knife member enables the knife edge to be selectively positioned along the die drum at any of a plurality of small incremental positions.

10 Claims, 7 Drawing Figures

Fig. 1.
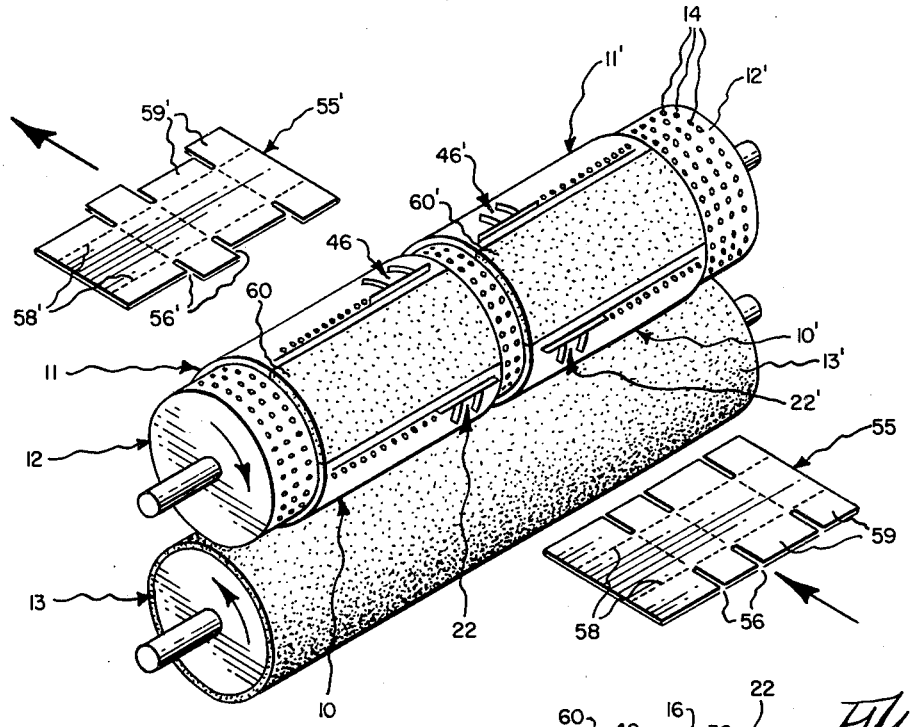
Fig. 4.
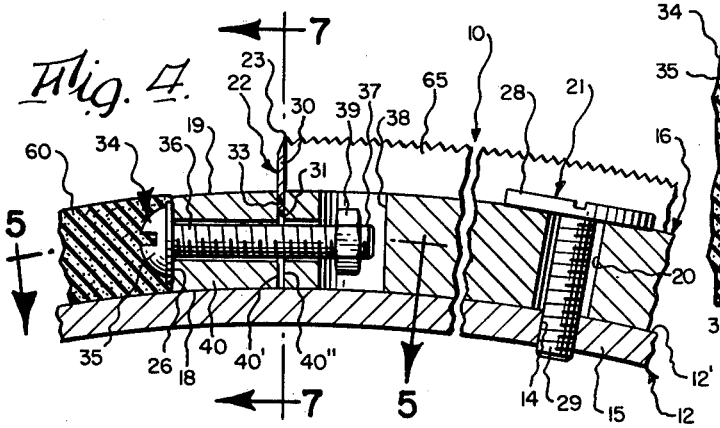
Fig. 5.
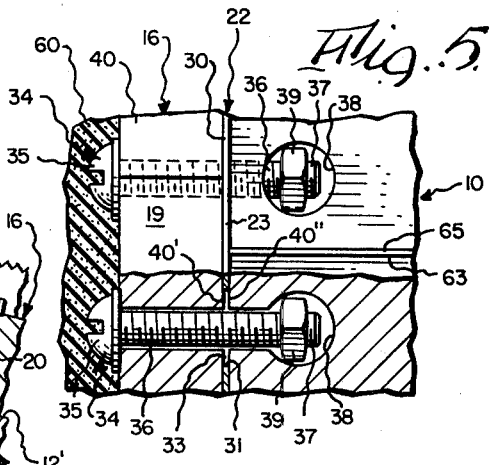
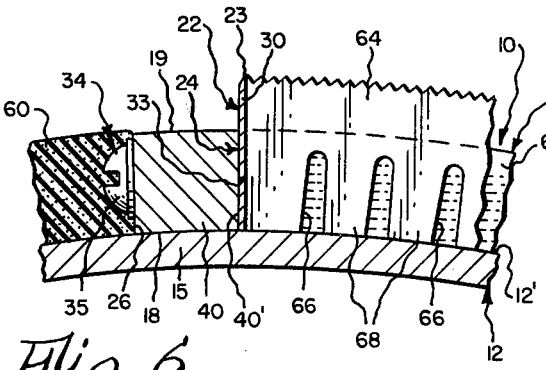
Fig. 6.
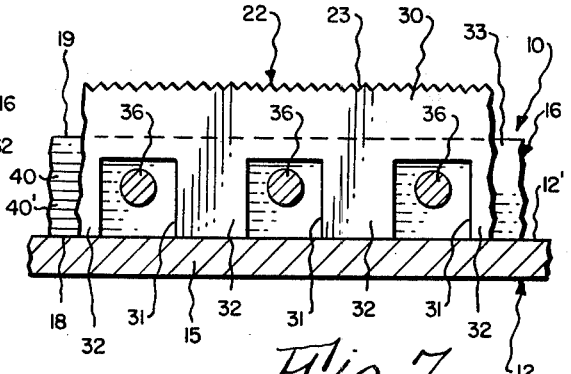
Fig. 7.

ROTARY CUTTING DIE

BACKGROUND OF THE INVENTION

Field of the Invention

The present invention relates generally to rotary cutting dies adapted to be mounted on a die drum of a rotary press, and more particularly to improved rotary cutting dies which are adapted to be adjustably positioned on such die drum to flap-cut planar slotted carton blanks.

Description of the Prior Art

Rotary presses are commonly provided with a die drum arranged to rotate in one angular direction, and a cooperative anvil drum arranged to rotate in an opposite angular direction. These die drums are conventionally provided with a plurality of tapped holes to facilitate mounting of one or more rotary dies thereon. The die and anvil drums are rotated in opposite angular directions so that a planar object interposed at the nip between these drums will be grabbed and translated therebetween.

Rotary cutting dies which are adapted to be mounted on the die drum, are known. However, these prior aut cutting dies did not permit longitudinal and/or circumferential positioning adjustment relative to the die drum to the degree required.

In the manufacture of corrugated containers, present practice may require that the flaps or corners of the carton blank be appropriately cut or sized so that when the carton is assembled, opposite flaps will meet but not overlap one another.

Heretofore, it has been the practice to provide one or more individual rotary cutting dies for each particular carton shape. However, since such cartons are not manufactured only in standard sizes, a large number of such dies have been required to accomodate the variations in carton shape. Desirably, a rotary cutting die should afford the capability of longitudinal and circumferential adjustment so that a single set of dies may be used to flap-cut carton blanks of varying shapes and sizes.

SUMMARY OF THE INVENTION

The present invention provides an improved rotary cutting die which is adapted to be mounted on a rotatable cylindrical die drum of a rotary press to cut a planar object, such as a corrugated carton blank, when passed between such rotating die drum and a cooperative oppositely-rotating anvil drum of the press.

The inventive rotary cutting die broadly includes a die board having a concave surface adapted to cover a cylindrical surface portion of the die drum, an opposite convex surface, and a plurality of longitudinally-spaced openings extending radially therethrough; fastening means, such as a conventional headed fastener, adapted to engage the die board and such of the die drum holes which are exposed through the die board openings, and selectively operable to hold the die board to the die drum at a selected position; knife means adapted to be selectively mounted on the die board at any of a plurality of large incremental positions in a longitudinal direction and having a knife edge adapted to extend radially beyond the convex surface to cut the object; and holding means mounted on the die board and selectively operable to hold the knife means at any selected one of the large incremental positions.

In one embodiment, the die board openings are longitudinally-elongated to permit the die board to be shifted in a longitudinal direction when the fastening means are loosened.

In another embodiment, the die board openings are circumferentially-elongated to permit the die board to be shifted circumferentially relative to the die drum, and are uniquely spaced from one another in a longitudinal direction so that some of these openings will register with some of the underlying die drum holes at each of a plurality of discrete positions in a longitudinal direction. In this embodiment, the knife edge may be moved longitudinally relative to the die drum to any of a plurality of small incremental positions spaced evenly from one another by compound movement of the die board relative to the die drum and the knife means relative to the die board. If desired, a tolerance may be provided to permit the knife means to be moved to any longitudinal position relative to the die drum.

In either embodiment, the knife means may be a platelike member having a serrated waverly cutting edge, and provided with a plurality of recesses extending into the member from an opposite edge. The holding means may include a longitudinally-elongated slot provided radially through the die board, and a plurality of longitudinally-spaced fasteners passed tangentially through this slot and selectively operable to contact the walls of the slot against the interposed knife member.

Accordingly, one object of the present invention is to provide an improved rotary cutting die which may be adjustably positioned in a longitudinal direction along a cylindrical die drum.

Another object is to provide an improved rotary cutting die which may be adjustably positioned in a circumferential direction relative to a cylindrical die drum.

Another object is to provide an improved rotary cutting die which may be adjustably positioned in both longitudinal and circumferential directions relative to a cylindrical die drum.

Still another object is to provide an improved rotary cutting die which is adapted to flap-cut or corner-cut slotted carton blanks, and having a knife edge which may be adjustably positioned relative to the die drum of a rotary press.

These and other objects and advantages will become apparent from the foregoing and ongoing specification, the drawings, and the appended claims.

BRIEF DESCRIPTION OF THE DRAWINGS

FIG. 1 is a perspective schematic view of the rotatable die and anvil drums of a rotary press; showing four embodiments of the inventive rotary cutting die operatively mounted on the die drum; and further depicting, in the rightward foreground, the shape of a typical slotted and scored rectangular carton blank before the flap-cutting operation, and depicting, in the leftward background, the shape of such carton blank after the flap-cutting operation.

FIG. 4 is a further enlarged fragmentary transverse vertical sectional view thereof, taken generally on line 4—4 of FIG. 2, illustrating a fastener of the fastening means holding the die board to the die drum, and further showing the knife-receiving slot and a horizontal fastener of the holding means.

FIG. 5 is a fragmentary transverse horizontal sectional view thereof, taken generally on line 5—5 of FIG. 4, and principally illustrating the knife-receiving slot and fasteners of the holding means.

FIG. 6 is a further enlarged fragmentary transverse vertical sectional view thereof, taken generally on line 6—6 of FIG. 2, showing the knife member in transverse cross-section and further showing a fragmentary portion of an arcuate scrapcutting knife in elevation.

FIG. 7 is a fragmentary longitudinal vertical sectional view thereof, taken generally on line 7—7 of FIG. 4, depicting the knife member in elevation and further showing the shank portions of the holding means operatively received in the recesses of the knife member.

DESCRIPTION OF THE PREFERRED EMBODIMENTS

Figures 2, 3:
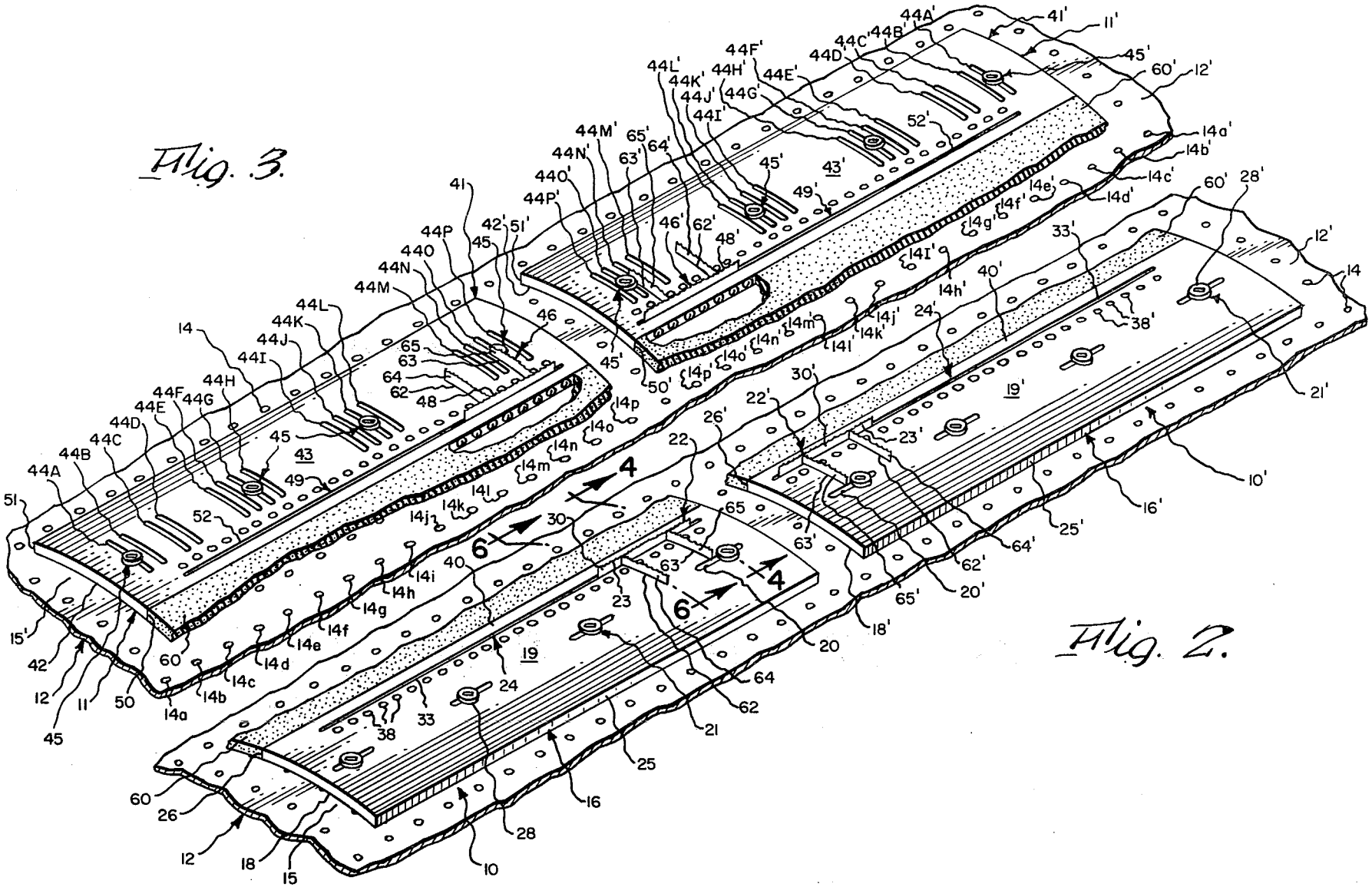
FIG. 2 is an enlarged fragmentary perspective view of a first preferred embodiment of the rotary cutting die operatively mounted on a leading portion of the die drum, this view showing the arcuate die board, the longitudinally-spaced longitudinally-elongated openings therethrough, the fastening means, the knife means, and the holding means.
FIG. 3 is an enlarged fragmentary perspective view of a second preferred embodiment of the rotary cutting die shown operatively mounted on a trailing portion of the die drum, this view showing the arcuate die board, the longitudinally-spaced circumferentially-elongated openings therethrough, the fastening means, the knife means, and the holding means.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring generally to the several drawing figures, the present invention provides an improved rotary cutting die which is adapted to be mounted on a rotatable cylindrical die drum of a rotary press. In FIG. 1, four presently preferred embodiments of the inventive cutting die, generally indicated at 10, 10′, 11 and 11′, are shown operatively mounted on an upper horizontally-elongated cylindrical die drum 12 which is adapted to be rotated about its longitudinal axis in a clockwise direction, this being indicated by the direction of the arrow on the left end face of die drum 12. Such rotary press is further shown as including a cooperative lower horizontally-elongated cylindrical anvil drum 13 arranged below die drum 12 and adapted to be rotated about its longitudinal axis in an angular direction opposite that of die drum 12, this being indicated by the counterclockwise direction of the arrow on the left end face of the anvil drum 13. It will be readily appreciated by persons skilled in this art that the cooperative die and anvil drums 12, 13 may be rotated in such opposite directions at the same angular speed to establish rolling contact between their cylindrical surfaces 12′, 13′ respectively.

By way of further explanation, the die drum 12 may have a typical diameter of about 19 3/16 inches and have an operative length of from about 80 to 120 inches. Such die drums are also conventionally provided with a series of circumferentially-spaced rows of longitudinally-spaced radially-extending tapped holes, these being severally indicated at 14 for die drum 12. Conventionally, these holes 14 are evenly spaced from one another in each longitudinal row, and such rows are spaced uniformly about the circumference of the die drum, although not necessarily be the same amount as the longitudinal spacing between the adjacent holes of any row. Thus, if the diameter of the die drum is 19 3/16 inches, and it is desired to space twenty-five rows evenly thereabout, the nominal circumferential distance between the centerlines of holes in adjacent rows would be about 2.41 inches. For the specific die drum 12 herein illustrated and described, the nominal longitudinal spacing between the centerlines of holes 14 in any row is 2.00 inches, and twenty-five of such rows are provided evenly about die drum 12 at a nominal circumferential centerline spacing of about 2.41 inches.

FIRST PREFERRED EMBODIMENT (10,10′)

Referring now collectively to FIGS. 1 and 2, a first preferred embodiment of the inventive rotary cutting die is indicated at 10 and is shown operatively mounted on a leading cylindrical surface portion 15 of die drum 12. Inasmuch as the rightward embodiment 10′ in FIG. 2 is a mirror image of leftward embodiment 10, only the leftward embodiment 10 will be expressly described, it being understood that the same reference numeral primed will identify the corresponding element and/or portion of right die 10′.

As best shown in FIGS. 2 and 4, rotary cutting die 10 includes a die board, generally indicated at 16, having a concave surface 18 adapted to cover a portion 15 of die drum cylindrical surface 12′, an opposite convex surface 19, and a plurality of longitudinally-spaced longitudinally-elongated openings or slots, severally indicated at 20, extending radially therethrough; fastening means, generally indicated at 21, adapted to engage die board 16 and such of die drum holes 14 which are exposed through die board openings 20, and selectively operable to hold the die board 16 to the die drum 12 at a selected position; knife means, generally indicated at 22, adapted to be selectively mounted on die board 16 at any of a plurality of large incremental positions in a longitudinal direction and having a knife edge 23 adapted to extend radially beyond die board convex surface 19 to cut an object; and holding means, generally indicated at 24, mounted on die board 16 and selectively operable to hold the knife means 22 at any selected one of the large incremental positions.

In FIGS. 2 and 4, the die board 16 is shown as being a segment of a relatively thin-walled cylinder which present a longitudinally-elongated rectangular outline when viewed in plan, having a circumferential dimension of about 8 inches and a longitudinal dimension of about 30 inches. This die board 16 may be conveniently formed of a hard maple plywood, or equivalent, to have the diameter of its concave surface 18 equal the nominal diameter of the die drum 12, a radial thickness of about 5/8 inches, and longitudinally-extending leading and trailing faces 25, 26, respectively. Die board 16 is adapted to be selectively moved or shifted longitudinally along the die drum 12 from an initial position to any relocated position at which die board openings 20 will register with some of the die drum holes 14 in any given row. To this end, it is presently preferred to sapce the circumferential centerlines of openings 20 equally apart at multiples of two inches, and to configure each of openings 20 such that its longitudinal extent is equal to or greater than the longitudinal centerline spacing between die drum holes 14 plus the diameter of the fastening means 21. Thus, in the embodiment illustrated, the longitudinal extent of each of openings 20 is at least 2½ inches for a nominal fastening means diameter of one-half inch. The longitudinal spacing between the openings 20 is such than an exposed die drum hole 14 will be in the same relative position at each slot, thereby enabling the die board 16 to be shifted longitudinally along the die drum within the longitudinal limits of slots 20.

In FIG. 4, the fastening means 21 is shown as being a conventional flat-head fastener having a head portion 28 adapted to bear against die board convex surface 19, and having a threaded shank portion 29 passed through slot 20 and engaged with die drum tapped hole 14. Hence, the fastening means 21 may be selectively loosened to permit longitudinal movement of die board 16 relative to die drum 12, and selectively tightened to securely hold the die board 16 to the die drum 12 at a selected position. Persons skilled in this art will recognize that if it is desired to shift the die board 16 along die drum 12 a greater distance than that permitted by the longitudinal extent of slots 20, the four fastening means 21 may be relocated to another set of die drum holes 14 to permit such desired die board movement.

Referring now to FIG. 7, the knife means 22 is illustrated as being a thin longitudinally-elongated rectangular plate-like member 30 having a vertical height of about one inch such that the uppermost serrated wavery knife edge 23 thereof extends radially beyond the die board convex surface 19. This plate-like member 30 is shown further provided with a plurality of evenly-spaced square recesses 31 which extend upwardly from the bottom thereof for about one-half inch. The longitudinal demension of these recesses is also shown as being one-half inch, and the centerline spacing between adjacent recesses is one inch. Hence, the lower portion of member 30 is configured as an alternating series of square recesses 31 and bosses 32, for a purpose hereafter explained.

The holding means 24 comprises a longitudinally-extending slot 33 provided radially through the die board adjacent the trailing face 26 thereof; and a plurality of screw-type fasteners 34 spaced longitudinally along the die board at centerline distances of 1 inch to have their headed portions 35 arranged to bear against die board trailing face 26, their threaded shank portions 36 passed tangentially through slot 33, and their distal end portions 37 exposed in holes 38 provided radially through the die board 16. A nut 39 is threaded into each fastener end portion 37 and engages the cylindrical walls of hole 38 such that the fastener may be selectively tightened to cause the thin strip portion 40 of the die board to move toward the major portion thereof, thereby contracting the walls 40', 40'' of slot 33 against the interposed knife means 22. Alternatively, fasteners 34 may be selectively loosened to permit the knife means 22 to be withdrawn from slot 33, shifted longitudinally to a new selected location, and reinserted into this slot. Inasmuch as the recesses 31 of member 30 are spaced longitudinally on one inch centers, as are fasteners 34, it is apparent that the knife means 22 is adapted to be selectively mounted on the die board at any of a plurality of large incremental positions in a longitudinal direction, these large incremental positions being spaced one inch apart. Thus, the plate-like member 30 may be inserted into slot 33 at any large incremental position where recesses 31 may centrally receive fastener shank portions 36 (FIG. 7).

Therefore, die board 16 may be selectively and adjustably positioned along the die drum in a longitudinal direction.

SECOND PREFERRED EMBODIMENT (11, 11')

Referring now to FIGS. 1 and 3, a second preferred embodiment of the inventive rotary cutting die, generally indicated at 11, is shown operatively mounted on another portion 15' of die drum cylindrical surface 12'. Inasmuch as the rightward embodiment 11' shown in FIG. 3 is a mirror image of leftward embodiment 11, only the leftward embodiment will be expressly described, it being understood that the same reference numeral primed will identify the corresponding element and/or portion of right die 11'.

As best shown in FIG. 3, rotary cutting die 11 includes a die board, generally indicated at 41, having a concave surface 42 adapted to cover die drum cylindrical surface portion 15', an opposite convex surface 43, and a plurality of longitudinally-spaced openings, severally indicated by the numerical prefix 44 and individually identified by the suffix A-P, respectively, extending radially therethrough and adapted to register with some of die drum holes 14 at any of a plurality of discrete positions of the die board 41 relative to die drum 12; fastening means, severally indicated at 45, adapted to engage die board 41 and such of die drum holes 14 which are exposed through the die board openings 44 at each of the discrete positions, and selectively operable to hold the die board 41 to the die drum 12 at any selected one of these discrete positions; knife means, generally indicated at 46, adapted to be selectively mounted on die board 41 at any of a plurality of large incremental positions in a longitudinal direction and having a knife edge 48 adapted to extend radially beyond die board convex surface 43 to cut an object; and holding means, generally indicated at 49, mounted on die board 41 and selectively operable to hold the knife means 46 at any selected one of the large incremental positions, whereby by selective positioning of the die board 41 on die drum 12 and by selective mounting of the knife means 46 on the die board 41, the knife edge 48 may be adjustably positioned along die drum 12 in a longitudinal direction at any of a plurality of small incremental positions spaced evenly from one another, as hereinafter explained.

Still referring primarily to FIG. 3, die board 41 is shown as being a segment of a relatively thin-walled cylinder which presents a longitudinally-elongated rectangular 44A–44P when viewed in plan, having a circumferential dimension of about eight inches and a longitudinal dimension of about thirty inches. This die board may also be conveniently formed of a hard maple plywood, or equivalent, to have the diameter of its concave surface 42 equal the nominal diameter of die drum 12, a radial thickness of about 5/8 inches, and longitudinally extending leading and trailing faces 50, 51, respectively. Die board 41 is adapted to be selectively moved longitudinally along the die drum 12 to any of a plurality of discrete positions at which some of die board openings 44A-44P will register with some of die drum holes 14. To this end, the die board openings 44A–44P are uniquely spaced from one another such that the circumferential centerline of any one die board opening 44 is spaced longitudinally from the centerline of at least one adjacent die board opening by a distance equal to three-eithths of the longitudinal centerline distance between adjacent die drum holes 14. In the specific embodiment illustrated, such longitudinal centerline spacing between adjacent die drum holes 14 is two inches, and such longitudinal centerline spacing between one slot and at least one adjacent slot is therefore three-quarters of an inch. For a die drum having its holes 14 spaced longitudinally from one another on two inch centers, the specific spacing between slots 44A–P is provided in the following table.

| Centerline Spacing Between Slots (Location) | Longitudinal Distance (Inches) |
|---|---|
| 44A – 44B | 0.75 |
| 44B – 44C | 1.75 |
| 44C – 44D | 0.75 |
| 44D – 44E | 3.75 |
| 44E – 44F | 0.75 |
| 44F – 44G | 0.75 |
| 44G – 44H | 0.75 |
| 44H – 44I | 5.75 |
| 44I – 44J | 0.75 |
| 44J – 44K | 0.75 |
| 44K – 44L | 0.75 |
| 44L – 44M | 5.75 |
| 44M – 44N | 0.75 |
| 44N – 44O | 0.75 |
| 44O – 44P | 0.75 |

Moreover, each of openings 44A–44P is shown as being elongated in a circumferential direction to permit die board 41 to be selectively moved circumferentially relative to the die drum. Preferably, the extent of such circumferential elongation of openings 44A–44P is at least the circumferential distance between adjacent rows of holes 14 plus the diameter of the fastening means 45.

In the preferred embodiment, fastening means 45 are identical in shape and function to fastening means 21, previously described. As with die 10, the fastening means 45 may be selectively loosened to permit movement of die board 41 relative to die drum 12, and selectively tightened to securely hold die board 41 to the die drum at a selected position. Moreover, knife means 46 and holding means 49 are identical in shape and function to the knife means 22 and holding means 24, respectively, previously described with respect to die 10, with the exception that the elongated slot 52, corresponding to slot 33, is provided adjacent the leading face 50 of die board 41 in this second embodiment. Thus, the knife means 46 is adapted to be mounted in slot 52 provided through die board 41 at any of a plurality of large incremental positions, these being spaced one inch apart and being the nominal centerline distances between the recesses 31 of the knife member. However, it is apparent from an examination of FIG. 7 that the longitudinal width of recesses 31 is greater than the diameter of the shank portion 36 of tangential fasteners 34. This tolerance may be expressly provided to allow a fine or vernier displacement of the knife means relative to the die board. Typically, such tolerance should be at least one-half of the distance between the small incremental positions, as hereinafter described.

As noted above, the die board 41 is adapted to be selectively moved in a longitudinal direction relative to die drum 12 to any of a plurality of discrete positions at which some of die board openings 44A–44P will register with some of die drum holes 14 in any longitudinal row. In the preferred embodiment herein disclosed, four of die board openings 44A–44P register with four of die drum holes 14 at each of these discrete positions. If the die drum holes 14 in any longitudinal row are individually indicated by the subscript suffix a-p (from left to right in FIG. 3), it will be seen that from an initial discrete position at which the die board opening 44A registers with die drum hole 14b, the die board may be moved leftwardly to any of four discrete positions displaced from the original reference position by longitudinal distances of one-half, three-quarters, one and one-quarter, and two inches, respectively, or rightwardly to any of four discrete positions displaced from the original reference position by longitudinal distances of three-quarters, one and one-quarter, one and one-half, and two inches respectively. At each of these discrete positions, four of die board openings 44A–44P will register with four of the underlying die drum holes 14, as summarized in the following table:

| Displacement of Die Board | Alignment | (Die Board Opening/Die Drum Hole) | | | |
|---|---|---|---|---|---|
| | 2"L | 44A/14a | 44G/14e | 44K/14i | 44O/14m |
| | 1¾"L | | | | |
| | 1½"L | | | | |
| | 1½"48 L | 44D/14c | 44F/14e | 44J/14i | 44N/14m |
| | 1"L | | | | |
| | ¾"L | 44B/14b | 44H/14f | 44L/14j | 44P/14n |
| Left | ½"L | 44C/14c | 44E/14e | 44I/14i | 44M/14m |
| | ¼"L | | | | |
| Reference Position | O | 44A/14b | 44G/14f | 44K/14j | 44O/14n |
| | ¼"R | | | | |
| Right | 1½"R | | | | |
| | ¾"R | 44D/14d | 44F/14f | 44J/14j | 44N/14n |
| | 1"R | | | | |
| | 1⅜"R | 44B/14c | 44H/14g | 44L/14K | 44P/14o |
| | 1½"R | 44C/14d | 44E/14f | 44I/14j | 44M/14n |
| | 1¾"R | | | | |
| | 2"R | 44A/14c | 44G/14g | 44K/14k | 44O/14o |

Longitudinal displacement of the die board 41 relative to die drum 12 to a selected discrete position, coupled with selective displacement of the knife means 46 relative to the die board 41 will enable the elongated knife edge 48 to be adjustably positioned along die drum 12 at any of a plurality of small evenly-spaced incremental positions in a longitudinal direction. In the embodiment herein illustrated and described, the centerline spacing between such small incremental positions is one-eighth of the centerline spacing between die drum holes 14, or one-quarter inch. Thus, the ability to position the knife edge at each of such longitudinal small incremental positions is permitted by compound displacement of die board 41 and knife means 46. For example, to move the knife edge ¼ inch to the right, die board 41 is moved to a position 1¼ inches to the right, and the knife member is moved leftwardly one large incremental position, to produce a net rightward movement of the knife edge of ¼ inch. Conversely, to move the knife edge 1¾ inches to the left, the die board 41 is moved to a position ¾ inches to the left, and the knife member is moved leftwardly one large incremental position, yielding a net leftward movement of the knife edge of 1¾ inches. In this manner, the knife edge may be moved leftwardly or rightwardly from an initial reference position to small incremental positions spaced ¼ inch apart in a longitudinal direction. As with knife member 30, the recesses in knife means 46 may accommodate further adjustment to permit the knife edge 48 to be moved to any position along die drum 12.

Operation

Each of the rotary cutting dies 10, 10′, 11 and 11′ herein described is adapted to be mounted on a rotatable cylindrical die drum of a rotary press to cut a planar object passed between such rotating die drum and a cooperative anvil drum of the press which is adapted to be rotated in an opposite angular direction.

While each of dies 10, 10′, 11 and 11′ may be used singly to cut a planar object, the four dies may be used conjunctively to cut the flaps of a slotted carton blank, generally indicated at 55 in FIG. 1. In the manufacture of corrugated cartons, present practive prefers that a planar rectangular blank be slotted, and scored along fold lines, before the flaps and/or corners are cut to size. Hence, the carton blank depicted in FIG. 1 is shown provided with a plurality of slots 56, folding scores 58, and flaps 59. However, for a rectangular carton, the flaps 59 of this carton must be appropriately cut such that when the blank 55 is folded into the shape of the intended carton, opposite flaps will meet but not overlap one another.

To flap-cut carton blank 55, the rotary cutting dies 10, 10′, 11 and 11′ are mounted on the die drum 12 with dies 10, 10′ covering a leading portion thereof, and dies 11, 11′ covering a trailing portion thereof. Thereafter, the four dies may be longitudinally and circumferentially positioned relative to die drum 12 such that knife edges 23, 23′, 48 and 48′ will cut the desired flaps when the carton blank 55 is interposed at the nip between the die and anvil drums, grabbed, and translated therethrough. This is readily apparent from a comparison of the flap-cut carton blank 55′ depicted in the leftward background of FIG. 1, with the original carton blank 55 depicted on the rightward foreground of this figure.

It should be again noted that the inventive rotary cutting dies 10, 10′, 11 and 11′ may be used either singly or in combination to cut a planar object, such as carton blank 55, passed between the oppositely-rotating die and anvil drums.

To further understand this environment of use for dies 10, 10′, 11 and 11′, it should be noted that pieces of soft resilient rubber or sponge-like material 60, 60′ may be positioned between the inventive dies to eject the carton blank after the cutting operation has been completed.

Moreover, if desired, any of the dies may be provided with one or more circumferentially-elongated radial slots adapted to receive and hold circumferentially-elongated knives to cut the several remnants of the cut flaps into scrap. For dies 10, 10′, 11 and 11′, these slots are indicated at 62, 62′, 63 and 63′, respectively, and the scrap-cutting knives are indicated at 64, 64′, 65 and 65′, respectively. As representatively shown in FIG. 7, each of these scrap-cutting knives may have radially-elongated recesses 66 extending upwardly from the bottoms thereof, and adapted to fit over complementarily-shaped bosses 68 provided in the slots to inhibit relative movement between these scrap-cutting knives and their associated die boards.

In this manner, each embodiment of the inventive rotary cutting die is adapted to cut a planar object passed between the oppositely-rotating die and anvil drums.

It should be clearly understood that the inventive rotary cutting dies herein disclosed are not limited in their application to a flap-cutting or corner-cutting operation, but may be generally employed to cut any planar object. Of course, the specific length and configuration of the knife means may vary with the intended operation, and the present invention contemplates that such knives may be exchanged or substituted, depending upon the specific size and material of the object to be cut. Moreover, while the specific shape of several dies have been explicitly described, it will be apparent that proportional dimensions may be employed for other sizes or configurations of the die drum.

While the disclosed embodiments constitute presently preferred forms of the present invention, it will be understood by persons skilled in this art that various changes and modifications may be made without departing from the spirit of the invention which is defined by the following claims.

What is claimed is:

1. A rotary cutting die adapted to be adjustably mounted on a rotatable cylindrical die drum of a rotary press to cut a planar object passed between such rotating die drum and an oppositely-rotating cooperative anvil drum of said press, said die drum having at least one longitudinal row of uniformly-spaced radially-extending tapped holes, comprising:

a die board having a concave surface adapted to cover a cylindrical surface portion of said die drum, an opposite convex surface, and a plurality of longitudinally spaced circumferentially-elongated openings extending radially therethrough, said die board being adapted to be selectively moved circumferentially relative to said die drum to an infinite number of positions and longitudinally relative to said die drum to any of a plurality of discrete positions at which some of said die board openings will register with some of said die drum holes;

fastening means adapted to engage said die board and such of said die drum holes which are exposed through said die board openings at each of said discrete positions, and selectively operable to hold said die board to said die drum at any selected circumferential position and at any selected one of said discrete positions;

knife means adapted to be selectively mounted on said die board at any of a plurality of large incremental positions relative thereto in a longitudinal direction and having a knife edge adapted to extend radially beyond said convex surface to cut said object, said knife means being adapted to be moved to a particular large incremental position when said die board is in a particular discrete position to enable said knife edge to be coarsely positioned relative to said die drum at any of a plurality of small incremental positions spaced evenly from one another, said knife means being also adapted to be further displaced relative to said die board from each of said large incremental positions to enable said knife edge to be finely positioned relative to said die drum at any position between said small incremental positions; and holding means mounted on said die board and selectively operable to hold said knife means at any selected position relative to said die board;

whereby by such selective positioning of said die board and by such coarse and fine positioning of said knife means, said knife edge may be adjustably mounted on said die drum at any desired position in a circumferential direction, and at any desired position in a longitudinal direction.

2. A rotary cutting die as set forth in claim 1 wherein the centerline spacing between said large incremental positions is four times the centerline spacing between said small incremental positions.

3. A rotary cutting die as set forth in claim 1 wherein the centerline spacing between said small incremental positions is one-eighth of the centerline spacing between said die drum holes.

4. A rotary cutting die as set forth in claim 1 wherein said die board openings are spaced longitudinally from one another such that four of said die board openings register with four of said die drum holes at each of said discrete positions.

5. A rotary cutting die as set forth in claim 4 wherein the centerline of any one of said die board openings is spaced longitudinally from the centerline of an adjacent die board opening by a distance of three-eighths of the longitudinal centerline distance between adjacent die drum holes.

6. A rotary cutting die as set forth in claim 1 wherein said knife means is a plate-like member having one edge sharpened to form said knife edge and having a plurality of uniformlyspaced recesses extending into said member from an opposite edge.

7. A rotary cutting die as set forth in claim 6 wherein the centerline spacing between said slots is one-half of the centerline spacing between said die drum holes.

8. A rotary cutting die as set forth in claim 6 wherein said holding means comprises a longitudinal slot provided radially through said die board and adapted to receive said plate-like member, and a plurality of longitudinally-spaced fasteners passed tangentially through said slot and selectively operable to contract the walls of said slot against said plate-like member.

9. A rotary cutting die as set forth in claim 8 wherein the centerline spacing of said fasteners is equal to the centerline spacing of said recesses.

10. A rotary cutting die as set forth in claim 9 wherein each of said recesses has a longitudinal dimension equal to the diameter of said fastenres plus at least one-half of the distance between said small incremental positions to permit said knife edge to be selectively moved to any longitudinal position on said die drum.

* * * * *